US006450381B1

(12) United States Patent
Ernst et al.

(10) Patent No.: US 6,450,381 B1
(45) Date of Patent: Sep. 17, 2002

(54) DEVICE AND METHOD FOR GUIDING A TRANSVERSELY STABLE MATERIAL WEB

(75) Inventors: Thomas Ernst, Augustdorf; Harald Löffler, Bielefeld; Johannes Kaczmarek, Oerlinghausen, all of (DE)

(73) Assignee: Erhardt + Leimer GmbH, Augsburg (DE)

( * ) Notice: Subject to any disclaimer, the term of this patent is extended or adjusted under 35 U.S.C. 154(b) by 8 days.

(21) Appl. No.: 09/707,369

(22) Filed: Nov. 7, 2000

(30) Foreign Application Priority Data

Nov. 13, 1999 (DE) ..... 199 54 654
Jan. 18, 2000 (DE) ..... 100 01 816

(51) Int. Cl.[7] ..... B65H 15/013; B65H 20/02
(52) U.S. Cl. ..... 226/21; 226/185; 226/187; 226/190
(58) Field of Search ..... 226/21, 20, 17, 226/185, 187, 190

(56) References Cited

U.S. PATENT DOCUMENTS 2,718,156 A * 9/1955 Wright ..... 226/17 X
3,073,590 A * 1/1963 Romeo et al. ..... 226/187 X
3,664,561 A 5/1972 Feiertag
4,007,865 A * 2/1977 Crandall ..... 226/17
4,303,189 A * 12/1981 Wiley et al. ..... 226/17 X
4,805,892 A * 2/1989 Calhoun ..... 226/17 X
5,497,720 A * 3/1996 Kawasaki ..... 226/17 X
5,727,724 A * 3/1998 Dowling ..... 226/185 X
6,104,907 A * 8/2000 Obata et al. ..... 226/187 X
6,269,995 B1 * 8/2001 Rich et al. ..... 226/17

FOREIGN PATENT DOCUMENTS

| | | |
|---|---|---|
| DE | 28 44 528 | 4/1979 |
| DE | 2 062 831 | 7/1993 |
| EP | 0 519 261 | 12/1992 |
| WO | 97/29035 | 8/1997 |

* cited by examiner

*Primary Examiner*—Michael R. Mansen
*Assistant Examiner*—Minh-Chau Pham
(74) *Attorney, Agent, or Firm*—Collard & Roe, P.C.

(57) ABSTRACT

A device and method for guiding a transversely stable material web. The device contains at least one roller and one counter roller disposed on opposite sides of the material web. The roller and counter roller can be swiveled synchronously with each other, thereby holding the material web between each other with a clamping grip. This device provides a substantially higher guiding force in relation to the running direction of the web than devices with stationary abutments.

13 Claims, 1 Drawing Sheet

DEVICE AND METHOD FOR GUIDING A TRANSVERSELY STABLE MATERIAL WEB

BACKGROUND OF THE INVENTION

1. Field of the Invention

The invention relates to a device having independently rotating axially aligned rollers for guiding a transversely stable web of material. More specifically, the invention relates to a device and method for guiding a web of paper, cardboard, corrugated cardboard or plastic material.

2. The Prior Art

A device for guiding a web of material with transverse stability is known from EP 0 519 261 B1. This device comprises a plurality of rollers that are transversely spaced from each other in relation to the direction of the material web. These rollers are supported by a fork that can be swiveled by a servo-actuator (or servo-drive) about a swivel axle extending vertically in relation to the material web. By swiveling the rollers, it is possible to align the axles of the rollers at an acute angle in relation to the direction in which the material is running, thereby exerting a lateral force on the material web to guide the material web. In order to achieve an adequate guiding effect, it is necessary to force the rollers against the material web with adequate force. To accomplish this, a stationary support is provided on the opposite side of the material web. This known device for guiding a transversely stable web of material has been successfully employed in practical applications where the required lateral guiding forces are low. However, it has been found that these known devices need improvement because the cutting blades or rifling devices exert a high lateral force on the web. This prevents the rollers from tilting with adequate speed into their nominal positions, even with highest possible contact pressure and maximally inclined positioning.

SUMMARY OF THE INVENTION

It is, therefore, an object of the present invention to provide a device that offers an improved guiding effect, and which can be employed with cutting blades or rifling devices.

Another object of the invention is to provide a method of guiding a material web that allows rapid adjustment in the event the web runs astray.

These and other objects are accomplished by providing a device having a plurality of rollers that are pressed against the material web. These rollers are opposed by a plurality of counter rollers. Both the rollers and the counter rollers are rotatably supported, independently of each other, so that the rollers offer nearly no resistance to the material web. The rollers and the counter rollers are disposed transverse to the running direction of the web and are pivotally mounted. The rollers swing about an axle that is aligned substantially vertical in relation to the plane of the material web, so that when the rollers and the counter rollers are displaced and swiveled, they exert a guiding force on the material web. Since the material web is held between the rollers and the counter rollers by a clamping grip, relatively high holding forces can be achieved without obstructing the run of the material by excessive friction. This is contrary to a fixed support, which hinders both the run of the web and its guidance due to the frictional forces acting on the material web. The counter rollers support the effect of the rollers because they are capable of being displaced and swiveled, therefore an unexpectedly high lateral guiding force can be applied to the material web. If this device is disposed on a cutting blade, or on a rifling device, it is possible to adjust the lateral force exerted on the material web by the cutting blade or the rifling device, allowing the material web to be almost completely utilized. The number of rollers and counter rollers employed is dependent upon the width and physical properties of the material web, therefore the number varies depending on the given case of application. For instance, webs of corrugated cardboard can handle only low contact pressure without being permanently damaged. However, any excessive width of the rollers leads to undesirable shearing forces when the rollers are swiveled. Such shearing forces act on the material web and may damage it. In the present case, it is favorable to employ several rollers and counter rollers that are axially aligned and rotated independently of each other. When the rollers and the counter rollers are swiveled, the roller located in the inner circle will rotate slower than the roller located in the outer circle, which keeps shearing forces low.

If the material web is separated crosswise by a cutting device, the outgoing trailing end piece and the incoming leading end piece of the material web are not kept in their positions. However, the clamping grip applied by the rollers to the center of the web, provides a safe guiding effect so that the severed ends can be guided in the correct way. This means that such end or head pieces of the material web can be completely utilized, so that the collected waste is reduced. This increases the economy of the overall production.

Since the counter rollers are intended to support the guiding effect of the rollers, it is advantageous if the rollers and the counter rollers are synchronized in relation to each other. The adjustment of each of the rollers and counter rollers can be accomplished by a servo-actuator, in which case the servo-actuators are synchronized with each other via suitable synchronizing means. However, it is simpler if the counter rollers are actively connected with each other via a gearing, preferably a lever system. In this case, the rollers and the counter rollers are adjusted by a common servo-actuator and in a synchronous manner. Furthermore, since only one servo-actuator is required, control of the swiveling unit is simplified.

To apply adequate pressure to the web, irrespective of the thickness of the web, the rollers are adjustably set against the material web. Accordingly, the rollers can be swiveled about an axis that is aligned approximately vertical to the plane of the material web, and which is vertically adjustable in relation to the plane of the material web, so that the rollers have two degrees of freedom. The counter rollers are pivotally mounted in such a way that they can be swiveled only about a fixed axis, so that the counter rollers are not adjustable perpendicular to the plane of the material web. The counter rollers have only one degree of freedom. This ensures that the material web does not move vertically in relation to the plane of the material web, irrespective of the contact pressure adjusted for the rollers. This is important, especially in connection with webs of corrugated cardboard, because such webs should be guided in one plane without any reversing of the web in order to avoid damage to the web.

Swiveling the counter rolls about their axis of swivel simultaneously causes a displacement of the counter rollers, crosswise in relation to the running direction of the web. Such shifting results in an effective correction of the travel of the web.

Therefore, the counter rollers are capable of supporting the guiding effect of the rollers in the best possible way. It is advantageous if the counter rollers are pivotally mounted, swinging about a common axle. This will assure that the rollers and the counter rollers will oppose each other when they are in any position of swivel, so that the material web is always optimally held in the clamping grip.

Since the rollers are set against the counter rollers with substantial pressure, buckling can occur within the zone of the rollers especially at the head of new material web. As the material web is generally separated in places where it is spliced, web accumulation and buckling occurs frequently during the production process. Therefore, it is advantageous if at least one of the rollers or counter rollers is rotationally driven, so that they exert an advancing force on the web, and buckling of the material web is avoided.

It would be advantageous to drive several or all rollers or counter rollers. However, if the rollers were rigidly coupled with a common rotational drive, the individual rollers could no longer rotate independently of each other at different speeds, so that the advantage offered by using individual rollers instead of one wide rollers would be lost. Therefore, the rollers or counter rollers are mounted by friction grip on a common shaft that is driven by a rotational drive. The torque of the rotational drive is transmitted by the friction contact between the rollers and the shaft, whereby the individual rollers may each have different rates of revolutions (or rotational speeds). The space between the shaft and the rollers is preferably filled with a grease that is viscous and assures optimal transmission of the torque of the shaft. As an alternative, the shaft could be magnetized, in which case, the bearings of the rollers are made of a conductive metal. The rotating shaft generates a magnetic rotational field that in turn induces a magnetic eddy field in the rollers by which the torque of the shaft can be transmitted without rigidly coupling the rollers.

The rollers are forced against the material web by a spring. However, it is advantageous to press the rollers against the material web using a servo-actuator, preferably a pneumatic cylinder. The force of the contact pressure exerted by the rollers can be adjusted with the actuator in a finely sensitive manner, so that the device can be employed for all kinds of different material webs. For example, the force of the contact pressure is adjusted by changing the pressure in the pneumatic cylinder as needed. To compute the force on the contact pressure, web parameters are measured, such as the thickness or width of the web, and the rollers are automatically set by the servo-actuator.

The method according to the present invention comprises guiding a material web having transverse stability through a cutting blade or a rifling device. The blade or the rifling device exert substantial lateral forces on the material web, so that correspondingly high guiding forces are needed to compensate for such lateral forces. For this purpose, the method provides placing several rollers onto the material, approximately at the center, to press against the web. Counter rollers are placed opposite the rollers, under the material web. Due to the center position of the rollers and counter rollers, their effects of pull and push are optimally exploited, so that correction of the run of the web is obtained. The rollers and counter rollers are displaced or swiveled synchronously with one another, transversely in relation to the running direction of the web, so that the rollers and the counter rollers jointly exert a corresponding adjusting force on the material web. This force is directed crosswise with respect to the direction in which the web is running. Furthermore, such synchronous swiveling of the rollers and the counter rollers assures that the web is maintained in a clamping grip in any position of swivel in which the rollers or the counter rollers may be positioned. This raises the adjusting force exerted by the rollers and the counter rollers. Therefore, the adjusting force exerted on the material web by the rollers and the counter rollers is higher than the lateral force applied by the blade or the rifling device, thereby assuring exact guiding of the material web. This means that guiding hooks, as employed in the prior art and damage the edges of the material web, can be omitted. Furthermore, this exact guiding of the material web provides for less waste of the material web.

In order to assure that the web is running in a defined course, it is advantageous if the deviation in the run of the web is measured and controlled to a nominal value by shifting or swiveling the rollers and the counter rollers.

Because of the particularly high lateral forces caused by the cutting blade or the rifling device, their adjustment crosswise results in great deviations in the run of the web that are difficult to compensate. It is advantageous in this case to compute the lateral displacement of the blades or rifling devices and to take this deviation into account to control the run of the web. This results in an especially rapid compensation of the run of the web, because the rollers or counter rollers are swiveled even before the expected deviation in the run of the web is detected by the measuring techniques. Furthermore, the deviation caused by the cutting blades or rifling devices is reduced by the measurements because when the cutting blades or the rifling devices are shifted, the rollers or counter rollers have already been set to a corresponding angle in relation to the running direction of the web. This means that the deviation caused by the blades or rifling devices is lower.

It is important in the production process of the material web that the material web is severed by the cutting blades or the rifling devices at the site where separation is intended. This is accomplished by making the nominal value in the control of the run of the web dependent upon the position of the blades or rifling devices. A measured value that is directly proportional to the position of the blades or rifling device is preferably used as the nominal value.

For the purpose of achieving an optimal cut or correct rifling of the material web, it is advantageous to control the blade or the rifling device in such a way that the devices will monitor the position of the material edge or an imprinted marking. In the event of a sideways deviation, the blade or the rifling device is displaced sideways correspondingly, so that the cutting or the rifling process is carried out correctly in spite of the web having gone "astray". In addition, the material web is returned to its starting position by the effect of the rollers and counter rollers having been set at an incline, or at least retained to such an extent that the run of the web is prevented from running further out of line.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
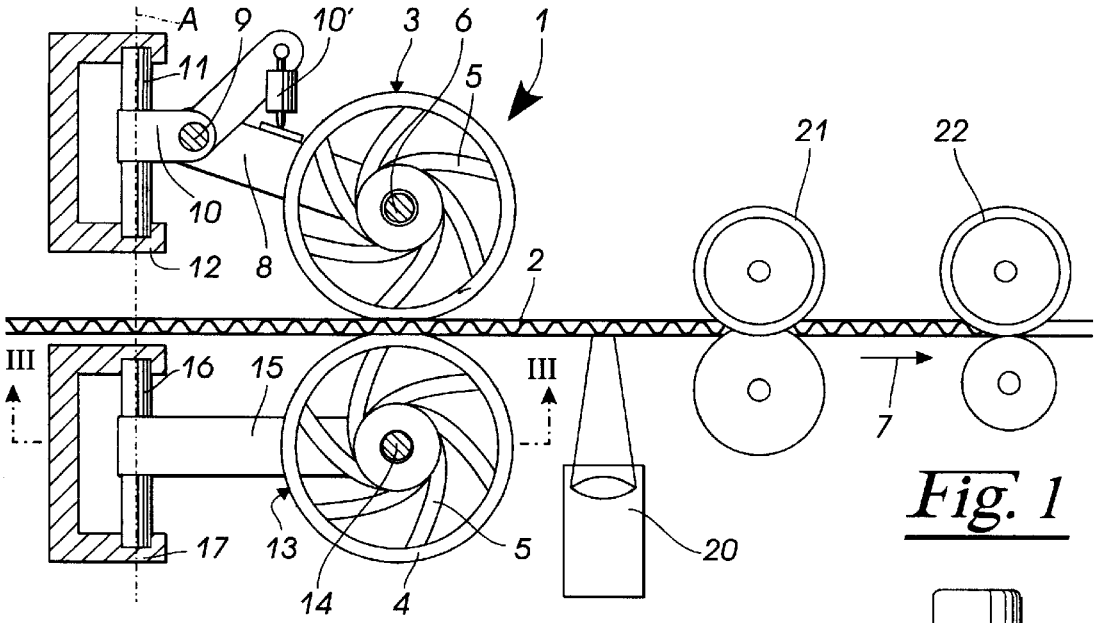
FIG. 1 shows a partial cross-sectional representation of a device for guiding a web of material.

Referring now in detail to the drawings and, in particular, FIG. 1 shows a device for guiding a transversely stable material web 2 having a plurality of rollers 3 and counter rollers 4. Rollers 3 and counter rollers 4 are made of plastic, in particular polyurethane, and can be elastically deformed to a certain degree. Such deformability is additionally increased by providing rollers 3 and counter rollers 4 with thin spokes 5, which do not extend in a radial way. Thus rollers 3 and counter rollers 4 rest flatly against material web 2, so that the contact pressure exerted by rollers 3 and counter rollers 4 is distributed over a larger surface area of material web 2. This prevents damage to material web 2 even when relatively high forces of contact pressure are introduced into the web by rollers 3.

Rollers 3 are supported on axles 6 and are freely rotatable, so that rollers 3 are driven to rotate by material web 2 traveling in direction 7. Axles 6 are supported on forks 8, which are pivotally mounted in a swivel bearing 9 of a receiving element 10. Forks 8 are pressed against material web 2 by a pneumatic cylinder 10', whereby the force of the contact pressure is adjustable by the pneumatic cylinder. Alternatively, forks 8 could be forced against material web 2 by a spring.

Receiving element 10 is supported on a rotational bolt 11 that in turn is pivotally mounted and supported in a frame 12. Frame 12 is stationarily supported above material web 2. For swiveling rollers 3 about a vertical axis "A" of rotational bolt 11, a servo-actuator engages receiving element 10 via a lever system (not shown). Rollers 3 press against material web 2 via swivel bearing 9, and actively swivel about the vertical axis "A" of rotational bolt 11. When rollers 3 assume a position pointing in running direction 7 of material web 2 at an acute angle, rollers 3 exert a force that is directed crosswise in relation to running direction 7 of the material web.

Opposite rollers 3, an abutment 13 is provided in the form of counter rollers 4, being disposed opposite from rollers 3. Rollers 4 are rotatably supported on a common shaft 14, which is supported on a fork 15. Fork 15 is directly supported on a rotational bolt 16 whose axis is aligned with the axis "A" of rotational bolt 11. Rotational bolt 16 is rotatably supported in a frame 17, which is stationarily supported below material web 2.

To control material web 2 with respect to its positioning, a camera 20 is provided. Camera 20 detects either the edge of the web or a marking imprinted on the material web and supplies the information to a controlling device. A cutting blade 21 is located directly behind camera 20, the cutting blade is displaceably supported and shifts transversely in relation to running direction 7 of the material web, and severs material web 2 lengthwise. Alternatively, provision may be made for a rifling device. This rifling device compresses material web 2 in running direction 7 in order to permit folding of material web 2. When cutting blade 21 or rifling device 22 are shifted transversely in relation to running direction 7, the blade or rifling device exert substantial lateral forces on material web 2. These lateral forces have to be compensated by device 1.

Figure 2:
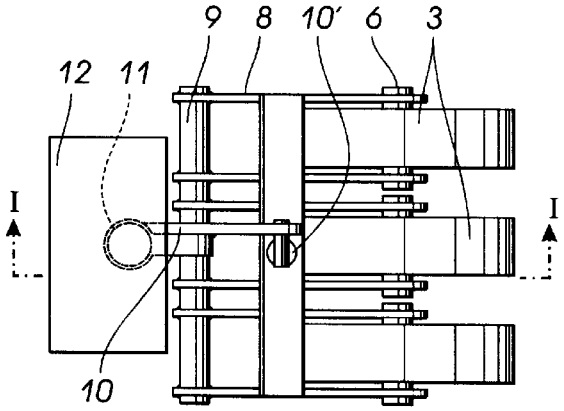
FIG. 2 shows a top view of the device according to FIG. 1.

FIG. 2 shows a top view of device 1 showing the structure of fork 8 with swivel bearing 9. The design of fork 8 with three rollers 3 supported on fork 8 is shown by way of example only and will depend on the width and physical properties of material web 2. Alternatively, one, two, or more than three rollers 3 can be provided. Rollers 3 may swing on swivel bearing 9 against material web 2 either jointly or independently of one another. If independently, a separate spring is provided for each roller 3, this spring being initially tensioned against material web 2. FIG. 1 represents section line I—I shown in FIG. 2.

Figure 3:
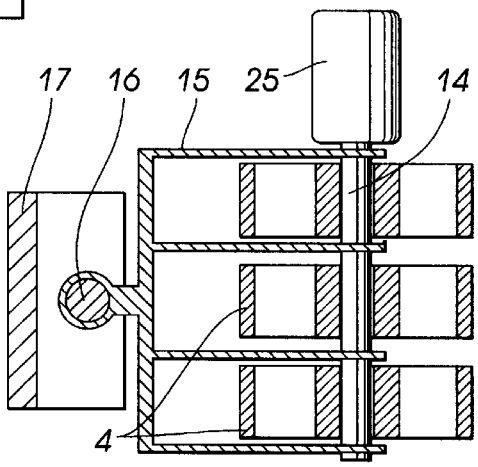
FIG. 3 is a cross-sectional representation of the device according to FIG. 1, with a section along section line III—III.

FIG. 3 shows a section through the device along section line III—III according to FIG. 1. As opposed to the support of rollers 3, counter rollers 4 are pivotally mounted to swing about rotational bolt 16, so that counter rollers 4 can not move vertically in relation to the plane of material web 2. Furthermore, counter rollers 4 are supported on a common shaft 14, being rotatably supported on fork 15. Shaft 14 is put into rotation by a rotational drive 25, whereby the space between shaft 14 and counter rollers 4 is filled with a viscous grease. The grease allows a torque to be exerted by rotational drive 25 on shaft 14, to counter rollers 4 without causing any rigid coupling of counter rollers 4. Counter rollers 4 exert a driving force on material web 2 that is directed in running direction 7 of the material web. Therefore, no buckling of material web 2 is caused by rollers 3 and counter rollers 4 especially at the head of material web 2. As an alternative, provision could be made for a greater or lesser number of counter rollers 4. For instance, a greater number of counter rollers 4 than rollers 3 could be provided to enhance the effect of abutment 13.

Figure 4:
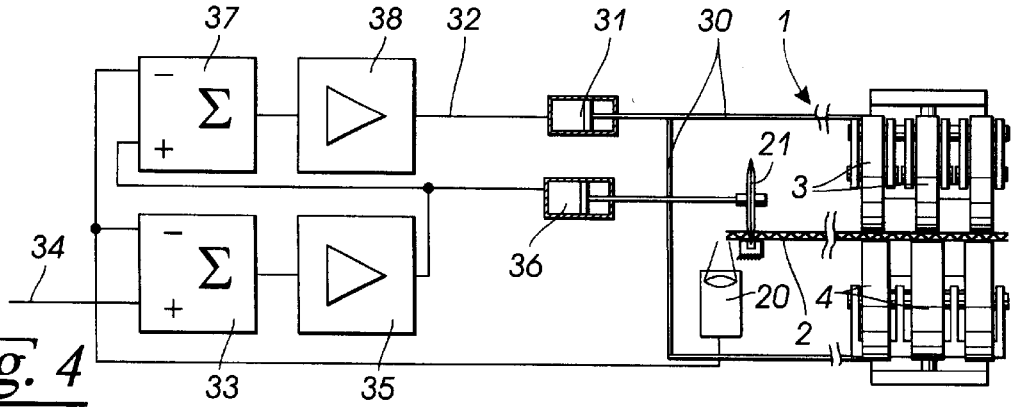
FIG. 4 shows the device according to FIG. 1 viewed against the running direction of the material web, with a schematic view of a controlling device.

FIG. 4 shows a schematic view of device 1 viewed against running direction 7. A schematically shown lever system 30 engages both receiving element 10 and frame 17 and synchronizes the swivel movements of counter rollers 4 with rollers 3. Lever system 30 is driven by a servo-actuator 31 which, for example, is represented by a hydraulic cylinder. As an alternative, any other type of drive could be employed, for example in the form of an electric motor.

In order to achieve adequate guidance of material web 2, a controlling device 32 is provided and is influenced by a signal that is detected by camera 20. The camera signal is supplied to an inverting input of an adder 33 whose non-inverting input receives a nominal value 34. On the output side, adder 33 is connected to a control amplifier 35 that preferably has a P-, PI- or PID- configuration. Control amplifier 35 in turn controls a servo-actuator 36 that drives cutting blades 21 or rifling devices 22 sideways. Cutting blades 21 and rifling devices 22 trail the edge of material web 2 or a marking line imprinted on the material web, so that a correct cut or grooving is obtained.

The displacement of cutting blades 21 or rifling devices 22, causes the run of material web 2 to be shifted accordingly. This running "out of line" is counteracted by device 1. The output signal of control amplifier 35 is connected to a non-inverting input of another adder 37, the non-inverting input forming the nominal-value input. The inverting input of adder 37 is fed with the signal from camera 20. Adder 37 is connected to the output side to a control amplifier 38 that preferably has a P-, PI or PID-configuration as well. Control amplifier 38 controls servo-actuator 31, which swivels rollers 3 and the counter rollers 4 via the lever system 30 and thus counteracts the deviation measured in the run of the web.

Accordingly, while only a few embodiments of the present invention have been shown and described, it is obvious that many changes and modifications may be made thereunto without departing from the spirit and scope of the invention.

What is claimed is:

1. A device for guiding a transversely stable material web (2) comprising:

a plurality of axially aligned rollers (3) for pressing against the top of material web (2), wherein said plurality of axially aligned rollers (3) are pivotally mounted and rotate independently from each other and are transversely displaced with respect to a direction of motion (7) of the material web (2); and a plurality of counter rollers (4) disposed on the opposite side of the material web from said plurality of axially aligned rollers (3) forming an abutment (13), wherein said counter rollers (4) are pivotally mounted and are displaced crosswise with respect to the direction of motion (7) of the material web (2);

wherein said axially aligned rollers (3) and said counter rollers (4) form a clamping grip at the center of the material web (2) and wherein at least two of said axially aligned rollers (3) and said counter rollers (4) are in frictional contact with a common shaft (14), said common shaft (14) being driven by a rotational drive (25).

2. The device according to claim 1, wherein said counter rollers (4) are coupled to said axially aligned rollers (3) via a gearing (30) and wherein said counter rollers are displaced and pivoted by a common servo-actuator (31).

3. The device according to claim 1, wherein said counter rollers (4) are supported by a holding means (15), which pivots about a fixed axis (A).

4. The device according to claim 1, wherein said axially aligned rollers (3) and counter rollers (4) are pivotally mounted, and swing about a common axis (A).

5. The device according to claim 1, wherein at least one of said counter rollers (4) is rotationally driven.

6. The device according to claim 1, wherein said axially aligned rollers (3) are pressed against the material web (2) by a servo-actuator (10'), wherein the force of contact pressure by said axially aligned rollers (3) is adjustable.

7. A method of guiding a transversely stable material web (2) comprising:

placing a plurality of axially aligned rollers against the center of the material web, said axially aligned rollers being rotated independently from each other and are displaced and swiveled crosswise with respect to a direction of motion (7) of the material web; and placing a plurality of counter rollers (4) forming an abutment (13) for supporting the material web, said counter rollers being on the opposite side of the material web from said axially aligned rollers (3) forming a clamping grip therebetween on the center of the material web and said counter rollers rotating independently of each other, wherein said counter rollers (4) are synchronously displaced and swiveled with said axially aligned rollers (3) and wherein at least two of said axially aligned rollers (3) and said counter rollers (4) are in frictional contact with a common shaft (14), said common shaft (14) being driven by a rotational drive (25).

8. The method according to claim 7, wherein the displacement and swiveling movements of said axially aligned rollers (3) and said counter rollers (4) are controlled depending on a measured deviation in the run of the web.

9. The method according to claim 8 further comprising:

placing at least one treatment device (21, 22) on the material web, said treatment device is transversely displaceable for computing the deviation in the run of the material web resulting from such displacement, such that displacement of said treatment device causes said web to be shifted accordingly.

10. The method according to claim 9, wherein a nominal value of the control of the run of the web is dependent upon the position of said treatment device (21, 22).

11. The method according to claim 9, wherein said treatment device (21, 22) monitors the material web by a marking imprinted on the material web.

12. The method according to claim 9, wherein said treatment device (21, 22) is a cutting blade (21).

13. The method according to claim 9, wherein said treatment device (21, 22) is a rifling device (22).

* * * * *